United States Patent [19]

Karr

[11] Patent Number: 4,660,016

[45] Date of Patent: Apr. 21, 1987

[54] MINIATURE THERMAL SWITCH ELONGATED BIMETALLIC ELEMENT

[75] Inventor: Dennis K. Karr, Sykesville, Md.

[73] Assignee: North American Philips Corporation, New York, N.Y.

[21] Appl. No.: 712,457

[22] Filed: Mar. 15, 1985

Related U.S. Application Data

[63] Continuation of Ser. No. 549,942, Nov. 9, 1983.

[51] Int. Cl.[4] ..... H01H 37/04; H01H 37/52

[52] U.S. Cl. ..... 337/372; 337/354; 337/365

[58] Field of Search ..... 337/372, 365, 354, 349, 337/346, 343, 89, 53

[56] References Cited

U.S. PATENT DOCUMENTS 3,205,328 9/1965 Maytnier ..... 337/354
4,317,097 2/1982 Hofsass ..... 337/343

FOREIGN PATENT DOCUMENTS 2030771 4/1980 United Kingdom ..... 337/354

*Primary Examiner*—Harold Broome
*Attorney, Agent, or Firm*—David R. Treacy

[57] ABSTRACT

A thermal switch utilizes a bimetallic element which has first and second layers which each have a length greater than the width thereof. The bimetallic element operates a switching contact and is mounted in free floating relationship within a housing.

4 Claims, 11 Drawing Figures

MINIATURE THERMAL SWITCH ELONGATED BIMETALLIC ELEMENT

This is a continuation of application Ser. No. 549,942, filed Nov. 9, 1983.

BACKGROUND OF THE INVENTION

The invention relates to thermal switches and particularly to miniature thermal switches utilizing a bimetallic element.

The prior art includes many thermal switches utilizing a circular bimetallic disc element. Such elements, at least in snap action switches, are bistable and change from a convex to a concave shape responsive to temperature change. The translation of such switch designs to a miniature size has not been wholly satisfactory because of difficult tolerance problems. More particularly, the physical movement of the bimetallic disc element due to temperature changes is often not sufficient to be compatible with production tolerances. Stated another way, for a specific temperature band there must be sufficient displacement to operate an electrical switch. The size of the bimetal element is constrained by the overall switch dimension requirements and the need for clearance for a cap or can support. Insufficient physical movement of the bimetal element due to temperature changes results in poor manufacturing yields and is typically overcome by imposing very tight tolerances on the switch components, which is costly.

The prior art includes at least one thermal switch made in Japan which utilizes an elongated bimetallic element in a snap action switch. The construction of that switch requires relatively complex assembly procedures including a requirement to tack weld an arm. The arm has an elongated bimetallic element fixed to the arm by means of tabs which extend from the arm to firmly engage the elongated bimetallic element. Thus, the manufacturing of such switches involve not only a tack weld but also a relatively difficult assembly involving the insertion of the bimetallic element into the tabs on the arms. The small size of the elements aggravates the difficulty of assembling the bimetallic element into the tabs of the arm and thus the assembly process for such switches is relatively complex. In addition the manufacturing of the individual components is also difficult.

The use of the full round bimetallic elements which are generally used requires that a can support be located around the perimeter of the disc seat. This reduces the possible size of the bimetallic element or requires a larger can.

It is an object of the invention to provide a bimetallic element for use in a miniature thermal switch which will have greater physical movement with a specific temperature change than was generally possible in bimetallic elements which have been generally utilized.

It is an object of the invention to provide a switch structure which will function with wider component tolerances in a given manufacturing lot and thus effectively result in a higher yield than has been previously been generally possible.

It is another object of the invention to maximize the size of the bimetallic element by locating the supports for the switch cap or cover at the side of and generally parallel to the bimetallic element, allowing the bimetallic element to be generally the same length as the switch base.

It is another object of the invention to provide apparatus which can be easily assembled and which minimizes the requirement for selective assembly to produce the final assembly.

It is an object of the invention to provide a thermal switch which is extremely compact.

SUMMARY OF THE INVENTION

It has now been found that these and other objects of the invention may be accomplished in a thermal switch which includes a bimetallic element having first and second layers and having a length greater than the width thereof. Means are provided for switching electrical power which include first and second electrical contacts and means are also provided for mounting the bimetallic element in free-floating relationship.

In some embodiments of the invention, the bimetallic element may be generally rectangular. The apparatus may also include a spacer member which is disposed intermediate the bimetallic element at least one of the electrical contacts. In some forms of the invention the spacer member is generally spherical.

BRIEF DESCRIPTION OF THE DRAWING

The invention will be better understood by reference to the accompanying drawing in which.

DESCRIPTION OF THE PREFERRED EMBODIMENT

Figure 1A:
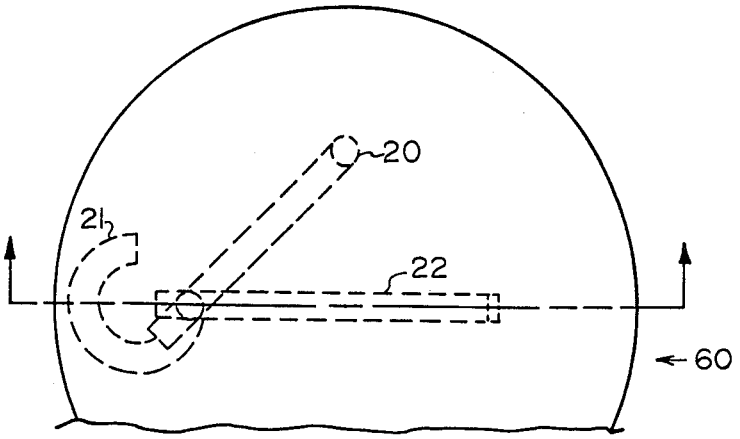
FIGS. 1A and 1B are respectively schematic plan and sectional views of the cap, bimetallic element and guide of the apparatus, in accordance with one form of the invention.
Figure 1B:
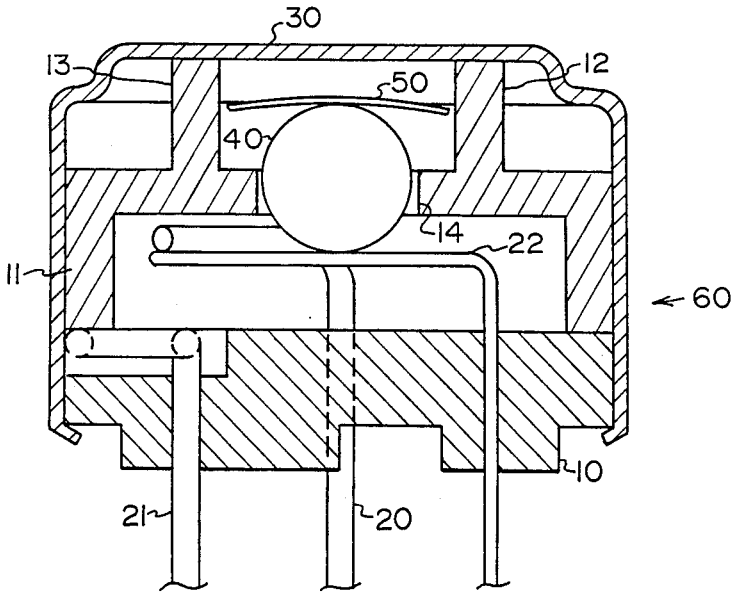
Figure 2A:
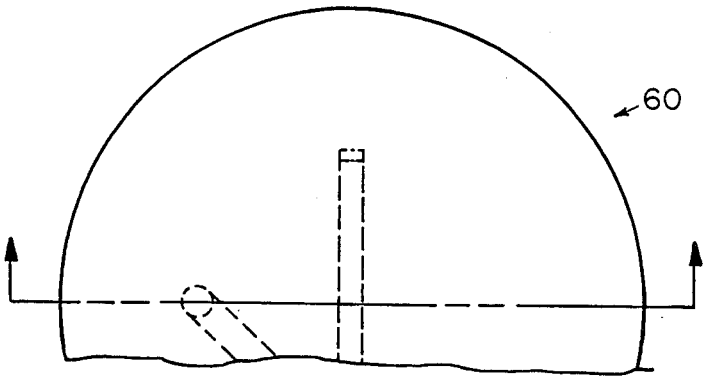
FIGS. 2A and 2B are respectively schematic plan and sectional views of the cap, bimetallic element and guide as shown in FIG. 1, in which the switch shown in FIGS. 1A and 1B have been rotated about the longitudinal axis thereof ninety degrees perpendicular to the view of FIG. 1.
Figure 2B:
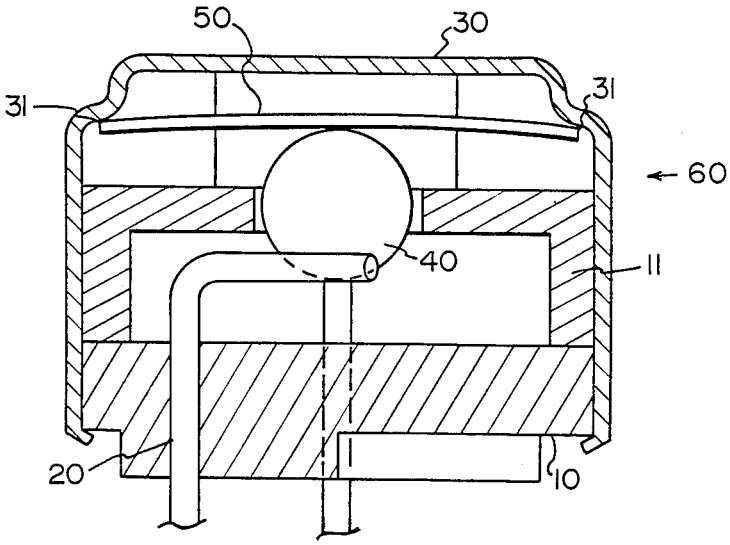

Referring now to FIGS. 1A, 1B, 2A, and 2B there is shown a first embodiment of the apparatus in accordance with the invention. The thermal switch 60 includes a bistable bimetallic element 50 which moves between a concave position, as shown in FIGS. 1 and 2, and a convex position. In the concave position the bimetallic element 50 is free floating or may bear lightly against the circular rib 31 of a cap 30, or a spherical element or ball 40. When the bimetallic element 50 assumes a convex shape the ball 40 causes a moving contact 22 to move downwardly and away from contact with a conductor 20. The moving contact 22 is biased by spring force to the up position where it makes contact with the conductor 20 when not constrained by the ball 40. Those skilled in the art will recognize that the orientation of the bimetallic element 50 may be varied to make a switch which is either normally open or normally closed. The cap 30 cooperates with the base 10 as does a guide 11 which guides the ball 40 as well as constrains the bimetallic element 50 to prevent movement away from the rib 31.

Figure 3:
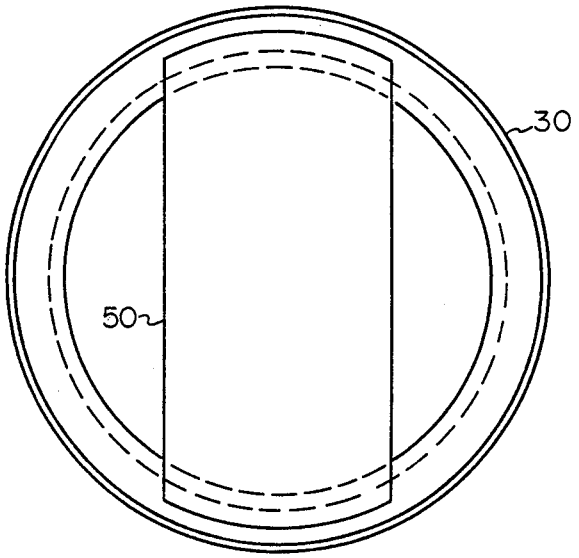
FIG. 3 is a partially schematic plan view of the apparatus shown in FIG. 1 after the top cap has been removed.
Figure 4:
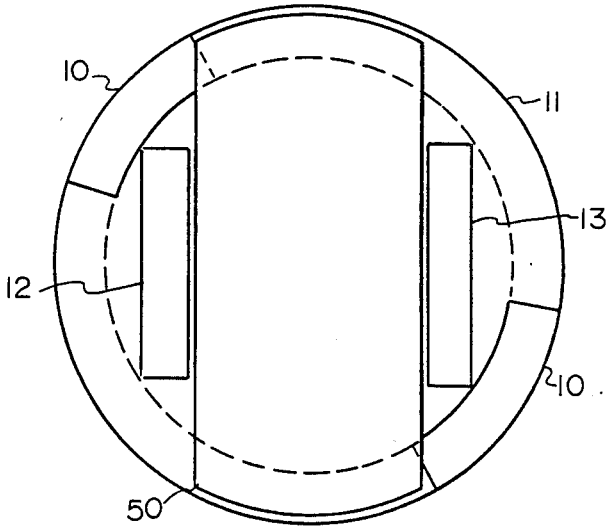
FIG. 4 is a schematic bottom view of the inner face of the top cap with a bimetallic element disposed between upstanding members in accordance with the invention.
Figure 5:
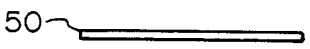
FIG. 5 is an elevational view illustrating the bimetallic element of FIG. 4 in greater detail.
Figure 6:
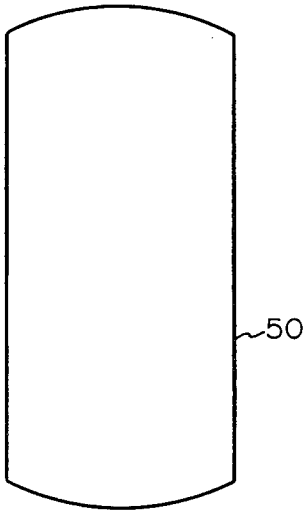
FIG. 6 is a plan view showing the bimetallic element in greater detail.
Figure 7:
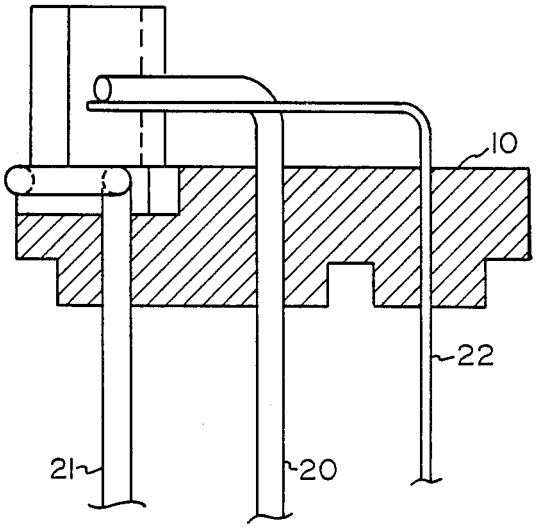
FIG. 7 is a partially schematic, partially sectional view showing the switch contact and a part of the structure for mounting the ball spacer member.

In the plan view of FIG. 3 the cap 30 has been removed to more clearly show the position of the general rectangular bimetallic element 50, which has a predetermined temperature setting.

The dimensions of the bimetallic element 50 in a preferred form of the invention which is particularly suited for installation on a printed circuit board switch are approximately 0.15 by 0.40 inches. Thus, it will be seen the dimensions of the bimetallic element 50 are very small. It will accordingly be seen that the size of the entire assembly is very small and thus particularly suited for many applications which were not previously possible. The bimetallic element 50 is constrained by a guide 11 shown in FIG. 1B which has upstanding elements 12, 13. The travel of the spherical glass ball 40 will be seen to be constrained by an opening 14 in the guide 11 which precisely positions the spherical glass ball 40 with respect to a movable contact 22. As shown in FIG. 3, the peripheral surface of the guide 11 will have tabs for engagement with the base 10. For simplicity these have been omitted in the drawings. The spherical glass ball 40 will be understood to rest on a movable contact 22 and push it away from a stationary contact 20 to break a contact when the bimetallic element 50 switches from concave to convex toward the movable contact 22. An additional wire 21 may engage the base 10 as well as a printed circuit board (not shown) to provide further stability to the mounting of the thermal switch 60 or to provide a connection to the switch cap.

Figure 8:
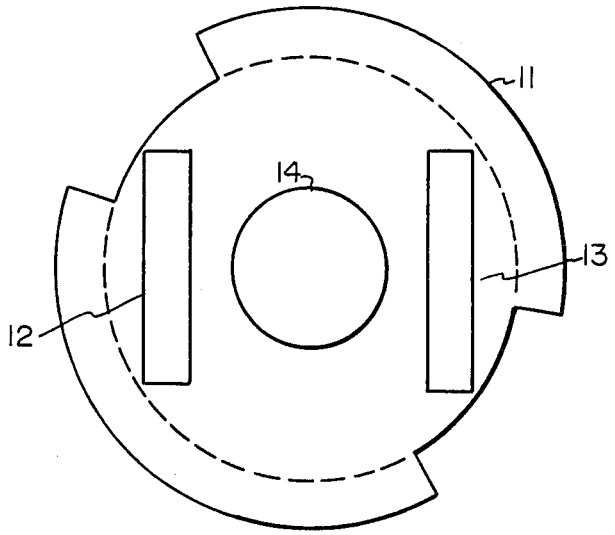
FIG. 8 is a plan view showing a locating guide in a variation of the embodiment of FIG. 1.
Figure 9:
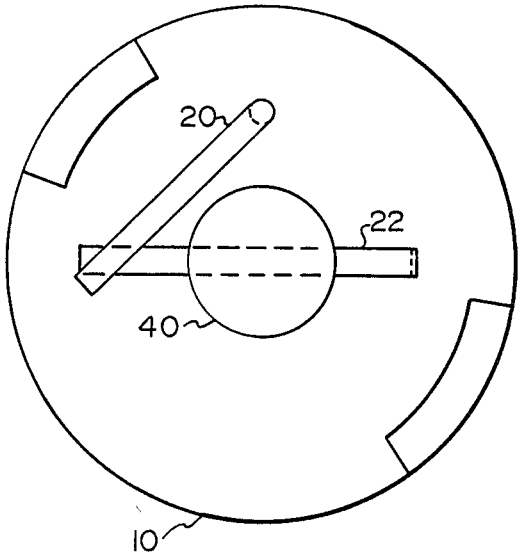
FIG. 9 is a partially schematic plan view of the apparatus shown in FIG. 1 after the cap, disc and guide have been removed.

FIGS. 8 and 9 illustrate another embodiment of the invention utilizing locating guides to position the elements.

Those skilled in the art will appreciate that the switch constructions shown in FIGS. 1–9 may be easily modified to make it either a normally open or normally closed switch. Test data has established that the generally rectangular or elongated bimetallic element in accordance with the invention has increased throw or physical travel as compared to the much more conventional full-round bimetallic element. The apparatus in accordance with the invention utilizes this characteristic to provide a very compact switch, and results in the acceptance of a very high percentage of any given manufacturing lot of assembled switches. The apparatus may be easily assembled without the necessity for welding.

The invention provides an element having greater physical movement than bimetallic elements which have been generally utilized. This greater physical movement makes possible relatively simple assembly procedures and production tolerances which result in the construction of a cost-effective miniature switch.

What is claimed:

1. A thermal switch comprising:

a bistable bimetallic element having two ends lying generally in a plane, comprising first and second layers, and having a generally rectangular shape with a length between said ends greater than the width thereof, first and second electrical contacts, means for moving at least one of said contacts between a first position in which said contacts make an electrical connection, and a second position in which said contacts are separated; said means including a spacer member, and means capturing said spacer member to allow movement of said member only in a given direction; and said means for moving being arranged to move said at least one of said contacts into a given one of said positions when said bimetallic element is in one stable condition, and means for constraining the position of said bimetallic element, said means for constraining including said spacer member; first and second substantially planar abutment surfaces disposed substantially in a plane perpendicular to said given direction, and arranged to be engaged by said ends when said element is in said one stable condition, said element having clearance to move in said given direction when in the other stable condition; first and second substantially parallel abutment surfaces, spaced apart a distance greater than said width such that the element fits therebetween with clearance allowing limited movement in the width direction; and means constraining movement of said element in the length direction and having clearance with respect to said ends, whereby said bimetallic element is free-floating when in said other stable condition.

2. A switch as claimed in claim 1, characterized in that said substantially planar abutment surfaces are formed on the inside of a cover of the switch, and said spacer member is formed of an electrically insulating material.

3. A switch as claimed in claim 2, wherein said spacer member is generally spherical.

4. A switch as claimed in claim 3, wherein said first and second electrical contacts are formed on respective first and second arms, disposed so as to overlap each other in said given direction, movement of said bimetallic element displacing said spacer member and causing at least one of said arms to move relative to the other in said given direction.

* * * * *